United States Patent [19]

Belokin, Jr.

[11] Patent Number: 4,630,740

[45] Date of Patent: Dec. 23, 1986

[54] MODULAR DISPLAY STAND

[76] Inventor: Paul Belokin, Jr., P.O. Box 1907, Denton, Tex. 76201

[21] Appl. No.: 656,361

[22] Filed: Oct. 1, 1984

[51] Int. Cl.[4] ..... A47F 43/00

[52] U.S. Cl. ..... 211/194; 248/174

[58] Field of Search ..... 211/194, 73, 72, 132, 211/188, 49.1, 149; 248/174; 229/DIG. 11; 206/509, 511, 512

[56] References Cited

U.S. PATENT DOCUMENTS

| | | | |
|---|---|---|---|
| 1,519,207 | 12/1924 | Kay . | |
| 1,576,672 | 3/1926 | Miller | 248/174 |
| 1,947,746 | 2/1934 | Thomson | 248/174 X |
| 2,043,483 | 6/1936 | Lynch | 248/174 |
| 2,066,844 | 1/1937 | Lynch | 248/174 |
| 2,150,743 | 3/1939 | Mancuso . | |
| 2,170,356 | 8/1939 | Stockes . | |
| 2,290,144 | 7/1942 | Katz . | |
| 2,291,265 | 7/1942 | Viglietta . | |
| 2,538,860 | 1/1951 | Buttery . | |
| 2,684,766 | 7/1954 | Blom . | |
| 2,715,509 | 8/1955 | Paige . | |
| 2,936,941 | 5/1960 | Lewis | 229/DIG. 11 |
| 3,089,632 | 5/1963 | Bartolucci . | |
| 3,300,166 | 1/1967 | Wojciechowski . | |
| 3,372,813 | 3/1968 | Ishida . | |
| 3,685,775 | 8/1972 | Fortunato | 248/174 |
| 3,877,396 | 4/1975 | Patterson . | |
| 3,987,737 | 10/1976 | Smith . | |
| 4,330,102 | 5/1982 | Gebhardt . | |

*Primary Examiner*—Ramon S. Britts
*Assistant Examiner*—Sarah A. Lechok Eley
*Attorney, Agent, or Firm*—Wood, Dalton, Phillips Mason & Rowe

[57] ABSTRACT

According to the invention, a collapsible display module has a wall blank with wall panels connected end to end foldably relative to each other to define a continuous wall structure. The wall blank is convertible between a flattened state wherein it can be readily stored and transported, and an expanded display state wherein pairs of opposed, facing panels bound a storage space. Flaps with associated teeth are foldably associated with the panels of one wall panel pair. The flaps on the one wall panel pair have teeth that can be meshed in mutually overlapping relationship to define a shelf for placement of display articles.

2 Claims, 7 Drawing Figures

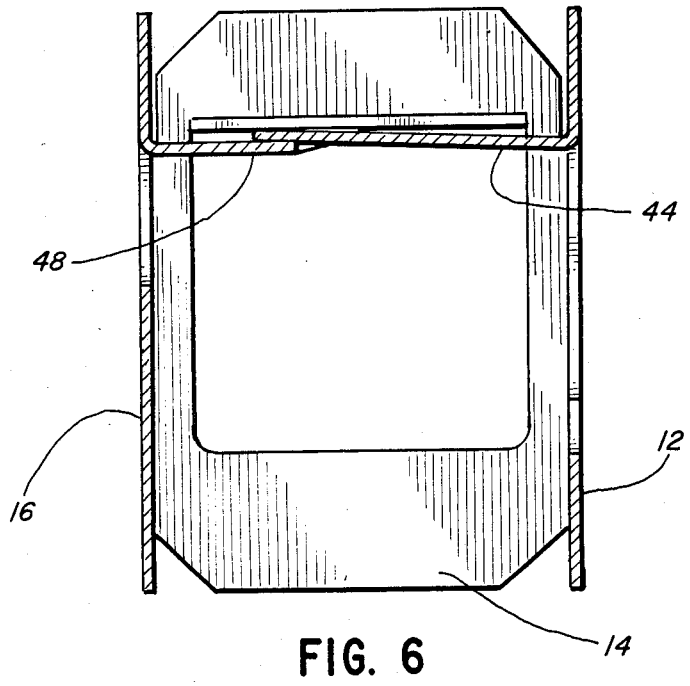
FIG. 6
FIG. 7
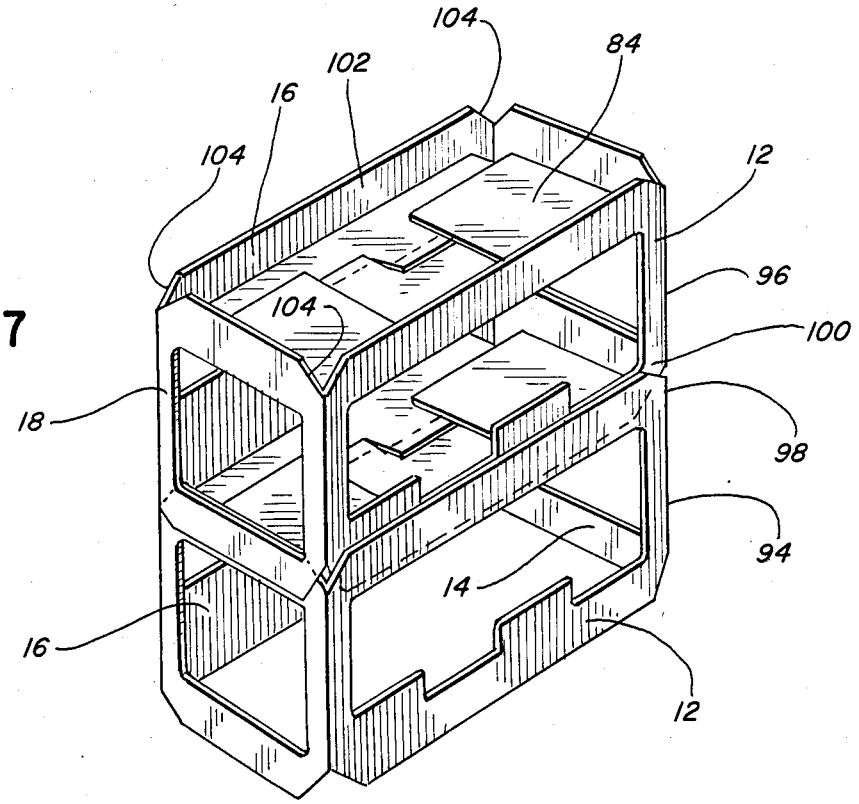

MODULAR DISPLAY STAND

BACKGROUND OF THE INVENTION

1. Field of the Invention

This invention relates to prefabricated display stands for exhibiting merchandise and, more particularly, to a display stand with folding modules that can be erected to a desired configuration.

2. Background Art

Prefabricated stands are commonly used for displaying merchandise in retail establishments, particularly supermarkets. It is known to make stands from cardboard or similar material that is compatible with low cost and lightweight construction.

An exemplary structure is shown in U.S. Pat. No. 3,372,813, to Ishida. In Ishida, separate corner columns and shelves are provided and are suitably joined to each other, as by staples, to derive a desired display stand configuration, dictated by the quantity and size of articles to be exhibited. Construction of the display stand is complicated by the several parts and fasteners required to assemble the parts. Further, the resulting display stand is semipermanent in nature and knock-down for reuse of the parts not contemplated. Rather, disposal is taught by Ishida after use, specifically by burning.

The present invention is specifically directed to overcoming the above enumerated problems in a novel and simple manner.

SUMMARY OF THE INVENTION

According to the invention, a collapsible display module has a wall blank with wall panels connected end to end foldably relative to each other to define a continuous wall structure. The wall blank is convertible between a flattened state wherein it can be readily stored and transported, and an expanded display state wherein pairs of opposed, facing panels bound a storage space. Flaps with associated teeth are foldably associated with the panels of one wall panel pair. The flaps on the one wall panel pair have teeth that can be meshed in mutually overlapping relationship to define a shelf for placement of display articles.

It is the principal object of the invention to provide a display module that can be readily converted from its flattened storage and shipment state to its display state without the use of tools, staples or other type of fastener. The meshing flaps prevent relative shifting of the panels with the module in its display state. Further, the flaps preferably have a squared configuration and can be intermeshed with the module in its display state so that the module does not have to be distorted as conversion is effected.

It is another object of the invention to provide display modules that are readily stackable, one atop the other, to produce a desired display capacity. At the same time, the modules cooperate with each other in stacked relationship to maintain each of the modules in its display state.

In accomplishing this end, the panel pair not carrying the toothed flaps has separate locking flaps which are situable in overlapping relationship with the meshed, toothed flaps. The locking flaps bear on the meshed flaps and maintain the same in engaged relationship. To effect stacking, each of the modules can be engaged telescopingly with an adjacent module. In accomplishing this, the weight of an overlying module bears on the locking flaps of an adjacent module to assure that disengagement of the flap pairs does not occur.

The invention also contemplates constructing the modules from a lightweight material so that the overall display configuration, in spite of its potential size, is light in weight and firmly founded by reason of the aforementioned module construction. The flap pairs can be struck directly from the blank and folded out therefrom to provide viewing openings for the displayed articles in the storage space. Little material waste results.

Other objects and advantages of the invention will become apparent upon reviewing the following detailed description taken in conjunction with the drawings and the appended claims.

BRIEF DESCRIPTION OF THE DRAWINGS

FIG. 6 is a sectional view of the assembled display module along line 6—6 of FIG. 5; and FIG. 7 is a perspective view of two modules in a stacked, display state.

DETAILED DESCRIPTION OF THE DRAWINGS

Figure 1:
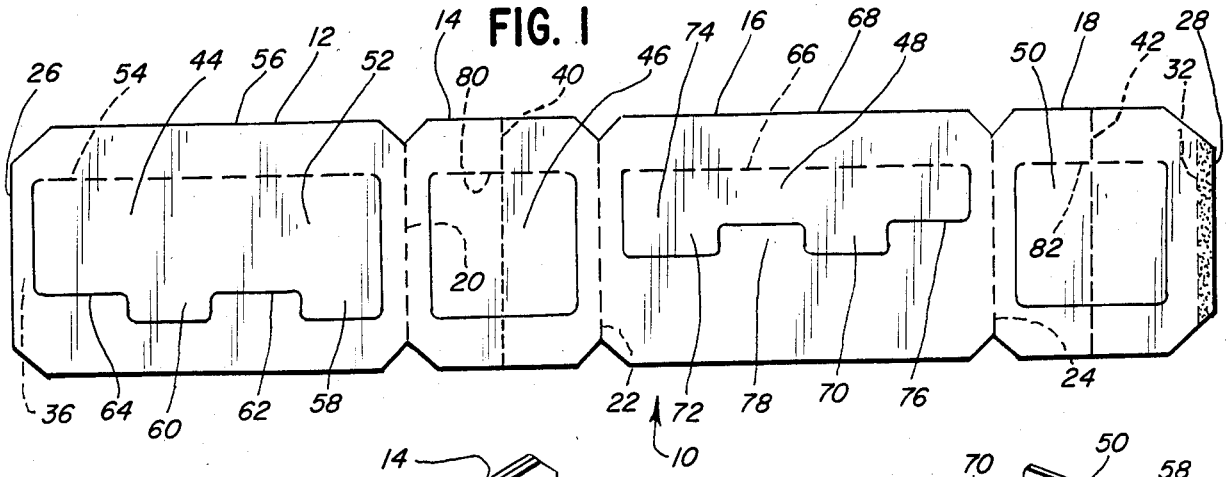
FIG. 1 is an elevation view of a blank used to form a display module according to the present invention.

A blank used to construct the display module according to the present invention is depicted in FIG. 1 at 10. Preferably, the blank is made from cardboard stock having sufficient rigidity to maintain its shape yet remain light in weight. The blank 10 comprises a series of wall panels 12, 14, 16, 18 connected end to end foldably relative to each other about lines 20, 22, 24 that may be perforated, scored or otherwise weakened so that folding of the panels relative to each other occurs in a predetermined fashion.

To provide a continuous wall structure, the free ends 26, 28 of the blank 10 are joined. The end 28 has an integral flap 30 which is bendable about a fold line 32 relative to the panel 18. An adhesive of a type known to those skilled in the art, is used to facially mate the surface 34 on the flap 30 with the flat surface 36 of the adjacent panel 12, as shown in FIG. 2.

Figure 3:
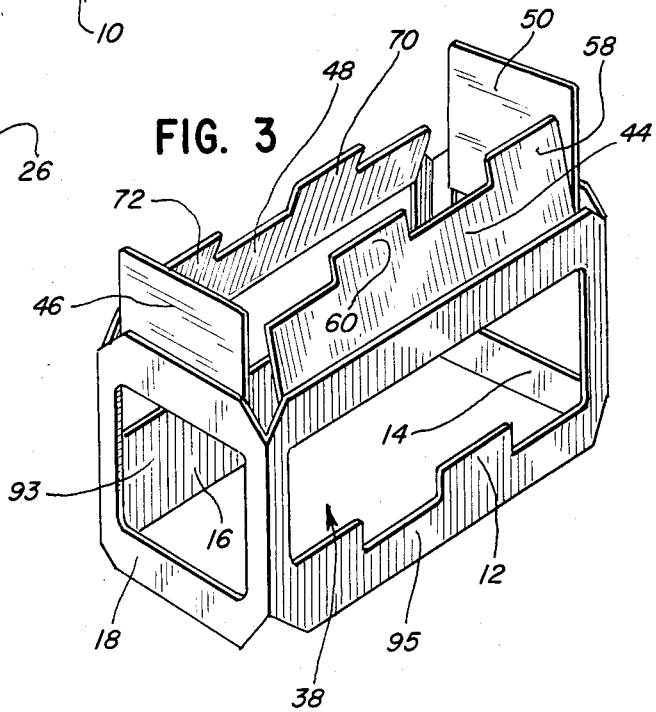
FIG. 3 is a perspective view of the display module demonstrating the first step in transforming the folded module to its display state showing opposed flap pairs folded upwardly relative to their associated panels.

With the ends 26, 28 joined, the blank can be adjusted about the fold lines 20, 22, 24 to situate the panel pairs 14, 18 and 12, 16 in opposed, parallel relationship, as depicted in FIG. 3. While each of the panels 12, 16 has a greater horizontal dimension than the pair, 14, 18, this is only a matter of design choice. The precise relative dimensions of the panels can be chosen depending on the desired display space 38 to be enclosed thereby.

Figure 2:
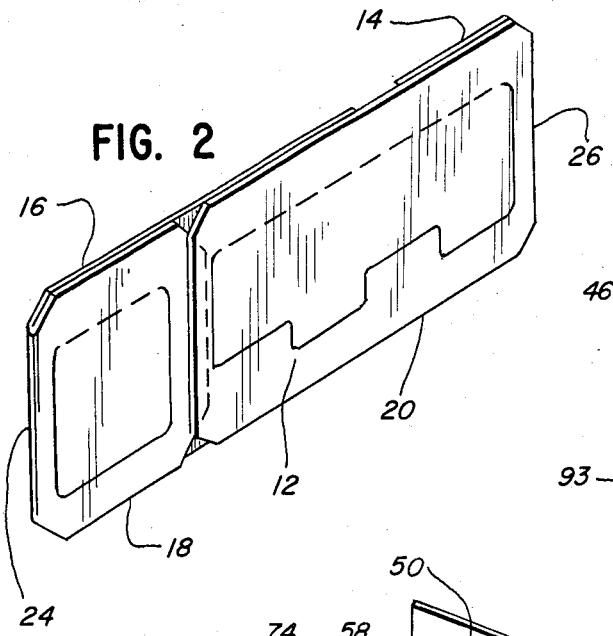
FIG. 2 is a perspective view of the display module in a folded state.

Another consideration in choosing the dimensions of the panels is the overall module dimension in its folded state in FIG. 2. This configuration is realized by folding the module about lines 20, 24 so that wall panels 14, 16 facially abut the panels 18, 20. The overall horizontal dimension of the folded module is approximately equal to the combined horizontal dimensions of one of the narrower and wider panels. Alternatively, additional fold lines 40, 42 can be provided on panels 14 and 18 respectively. The inclusion of the fold lines 40, 42 allows for accordian type folding inwardly of the module between panels 12, 16 so that the overall horizontal dimension of the folded module is reduced by the width of the narrower panels 14, 18 from the folded module of FIG. 2.

Figure 4:
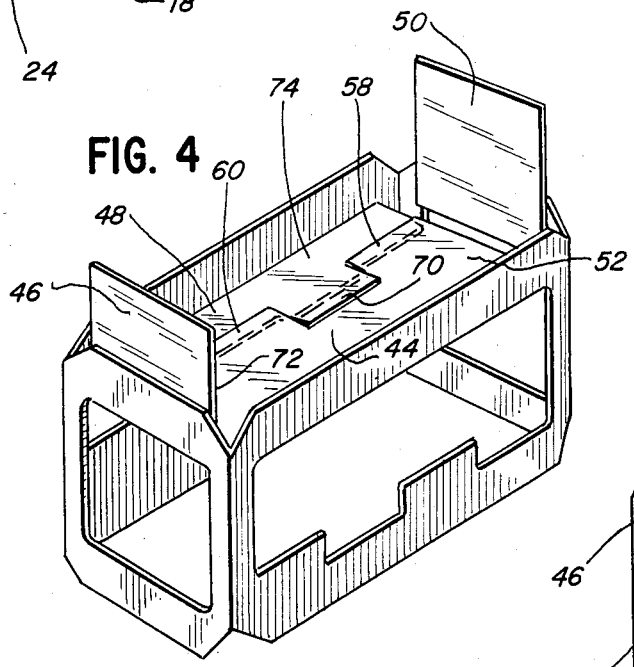
FIG. 4 is a perspective view of the module with one of the flap pairs intermeshed.
Figure 5:
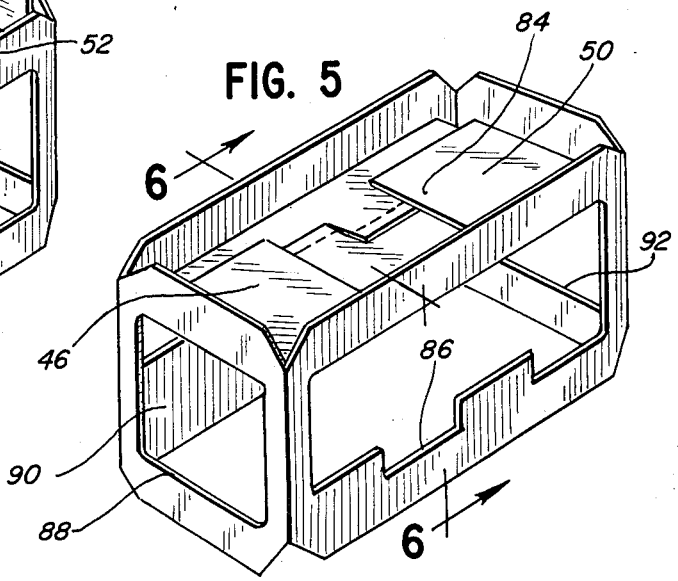
FIG. 5 is a perspective view of the module in its display state with the other pair of flaps folded down against the intermeshed pair.

The steps in converting the module from its folded state in FIG. 2 to its display state in FIGS. 5 and 6 are shown sequentially in FIGS. 3–5. In FIG. 3, the panels are folded relative to each other so that the corners are square. To maintain the squared relationship between the panels, flaps 44, 46, 48, 50 are struck from and remain integral with the walls of panels 12, 14, 16, 18 respectively.

Flaps 44 and 48 are shaped to intermesh with each other. Flap 44 comprise a body 52 integrally, foldably associated with the panel 12 along line 54. The fold line 54 is spaced beneath the upper edge 56 of the panel 12 for reasons that will become apparent subsequently. Body 52 has integrally formed teeth 58, 60 spaced from each other so as to define a saw tooth pattern with valleys 62, 64 between adjacent teeth. Flap 48 is integrally, foldably associated with panel 16 along line 66, spaced beneath the upper edge 68 of the panel 16, and has teeth 70, 72 extending from body 74 and alternating with valleys 76, 78.

The flaps 44, 48 are meshed with each other with the wall structure in its display state, shown in FIG. 5. The teeth on each of the flaps are squared and are dimensioned so that they can be intermeshed noninterferingly with teeth on the opposing flaps. To effect interengagement, each flap 44, 48 is initially folded upwardly about its respective fold line 54, 66 to the position shown in FIG. 3. The flaps are then folded towards each other and into meshed relationship shown in FIG. 4. In FIG. 4, teeth 58, 60 bear on the body 74 associated with the flap 48 and teeth 70, 72 on flap 48 bear on the body 52 of flap 44. The flaps are mutually supporting and resist further downward folding beyond a substantially horizontal position.

Locking flaps 46, 50 are struck directly from panels 14 and 18 and bendable about horizontal fold lines 80, 82 respectively. The fold lines 80, 82 are colinear with lines 54, 66 associated with the panels 12 and 16. Before folding down flaps 44, 48, flaps 46, 50 are folded upwardably about their respective fold lines to the position shown in FIG. 3. With the flaps 44, 48 intermeshed, flaps 46 and 50 are folded downwardly to bear on the teeth 60, 72 and 58, 70 respectively. As long as the flaps 46, 50 closely overlie the flaps 44, 48, the teeth cannot disengage.

The flaps 44, 46, 48, 50 cooperatively define an upwardly disposed shelf 84, seen in FIGS. 5 and 6, upon which display articles can be placed. The flaps 46, 50 as well as interfering with the flaps 44, 48, to prevent disengagement thereof, also cause a distribution of the weight of articles substantially over the flaps 44, 48. The tendency of the teeth or bodies to individually distort and the flaps to separate is thus substantially reduced. A sturdy shelf 84 results.

The flaps 44, 46, 48, 50, which define the shelf 84, upon being folded away from their respective wall panel, provide openings 86, 88, 90, 92 for viewing articles displayed in the space 38. The extension of the body 74 of flap 48 from its fold line is less than the corresponding extension of body 52 on flap 44. This results in a larger viewing opening in panel 12 which is intended as the front of the module. At the back of the module, an upright ledge 93 is defined by reason of the smaller body and confines articles in the space 38.

To enlarge the display space, the modules are stacked one atop the other as shown in FIG. 7. While two such modules 94, 96 are shown in FIG. 7, any number may be employed depending on the desired display capacity. Engagement between adjacent modules is accomplished by telescopingly mating the upper region 98 of one module with the lower region 100 of an adjacent module.

Because the fold lines 54, 66, 80, 82 are offset from the upper edge of the modules, a peripheral upstanding rim 102 is defined about the shelf 84. This rim 102 confines articles displayed on the shelf of the uppermost module and coacts with the lower region 100 of an adjacent, attached module to maintain the stacked relationship therebetween.

To effect telescoping engagement between adjacent modules, the lower region 100 of one of the opposed wall pairs 12, 16 is disposed between the corresponding walls on the adjacent, underlying module. The lower region 100 of the other panel pair 14, 18 on the one module is outside the corresponding wall panel pair on the underlying module. As a result the wall panels of each module are woven, alternating from inside to outside about the periphery of each module. To prevent interference at the corners between modules upon stacking the modules, V-shaped cutouts 104 are provided at the top and bottom at each module corner. The depth of the V is sufficient to allow the lower edge of each module to bear on the shelf of an underlying module. The cutouts 104 are provided on the top and bottom of each module to make them universal in nature.

With the above arrangement, the stacked modules are firmly enmeshed with each other. Further, the upper modules bear against the flaps 46, 50 on the modules upon which they are supported to keep the individual modules intact.

It should be understood that the foregoing detailed description was made for purposes of demonstrating the structure and operation of the invention with no unnecessary limitations to be understood therefrom.

I claim:

1. A collapsible display module comprising:

a wall blank having substantially flat wall panels connected end to end foldably relative to each other to define a continuous wall structure, said wall blank collapsible to a flattened state for storage and convertible to an expanded display state in which pairs of opposed, facing panels cooperatively bound a display space;

at least one flap associated with each of the wall panels of one said wall panel pair, said flaps each comprising a body and at least one tooth extending from the body; and means attaching the body of each said flap foldably relative to its respective wall panel so that said flaps can be situated in meshed, overlapping relation with each other with said blank in the display state without distorting the panels or the flaps, wherein the tooth on each flap overlies the body of the flap on the opposed panel, the extension of one of the bodies from its respective wall panel being greater than the extension of the other of the bodies from its respective wall panel so that a resulting opening in the wall blank from the flap with the one body is larger than an opening in the wall blank from the flap with the the other body, said flaps serving as shelves for placement of articles to be displayed and the panel with the flap with the other body has a larger retaining surface for articles on the shelf.

2. A collapsible display module comprising:

a wall blank having substantially flat wall panels connected end to end foldably relative to each other to define a continuous wall structure, said blank collapsible to a flattened state and convertible to an expanded display state in which opposed pairs of facing panels cooperatively bound a storage space;

at least one flap associated with each of the wall panels of one said wall panel pair, said flaps each comprising a body and at least one tooth extending from the body;

means attaching the body of each said flap foldably relative to its respective wall panel for situating said flaps in meshed, overlapping relation with each other wherein the tooth on each flap overlies the body of the flap on the opposing panel, the extension of one of the bodies from its respective wall panel being greater than the extension of the other of the bodies from its respective wall panel so that the resulting opening from the flap with the one body is larger than the opening from the flap with the other body, a flap foldably attached to each of the panels of the other wall panel pair for overlying situation with the flaps on the one wall panel pair, said flaps on the other wall panel pair bearing on the teeth to maintain the meshed, overlapping relationship of the flaps on the one wall panel pair, at least one of the flaps being struck directly from its respective panel to define an opening and integrally attached therewith, said opening permitting viewing of the articles in the storage space, said flaps on the wall panel pairs defining a shelf for placement of articles to be displayed, and the panel with the flap with the other body has a larger retaining surface for articles on the shelf.

* * * * *